US008275299B2

(12) United States Patent
You et al.

(10) Patent No.: US 8,275,299 B2
(45) **Date of Patent: *Sep. 25, 2012**

(54) TRANSFER UNIT AND IMAGE FORMING APPARATUS EMPLOYING THE SAME

(75) Inventors: Je-hwan You, Yongin-si (KR); Gyeong-ho Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/926,112

(22) Filed: Oct. 26, 2010

(65) Prior Publication Data

US 2011/0044732 A1 Feb. 24, 2011

Related U.S. Application Data

(63) Continuation of application No. 12/025,175, filed on Feb. 4, 2008, now Pat. No. 7,848,691.

(30) Foreign Application Priority Data

Jun. 20, 2007 (KR) ..... 2007-60246

(51) Int. Cl.
*G03G 15/20* (2006.01)

(52) U.S. Cl. ..... 399/308; 399/46; 399/55; 399/88; 399/302

(58) Field of Classification Search ..... 399/66, 399/79, 88, 279, 302, 306, 308, 310, 313, 399/315

See application file for complete search history.

(56) References Cited

U.S. PATENT DOCUMENTS

| | | | |
|---|---|---|---|
| 4,444,864 | A | 4/1984 | Takahashi |
| 4,739,363 | A | 4/1988 | Hoshika et al. |
| 5,043,239 | A | 8/1991 | Kukimoto |
| 5,732,314 | A | 3/1998 | Tsukida et al. |
| 5,946,538 | A | 8/1999 | Takeuchi et al. |
| 6,256,465 | B1 | 7/2001 | Yoshinaga et al. |
| 6,834,177 | B2 | 12/2004 | Saito et al. |

(Continued)

FOREIGN PATENT DOCUMENTS

EP 1873427 A1 1/2008

(Continued)

OTHER PUBLICATIONS http://www.asker.co.jp/en/products/durometer/anlog/cindex.html.

(Continued)

*Primary Examiner* — David Gray
*Assistant Examiner* — Francis Gray
(74) *Attorney, Agent, or Firm* — Staas & Halsey LLP

(57) ABSTRACT

A transfer unit, which transfers a toner image formed on at least one image support to a printing medium, and an image forming apparatus employing the same. The transfer unit includes: an intermediate transfer body to the toner image from the image support, which has a curved transfer surface and an ASKER-A hardness of from about 25° to 40°; a transfer member, which has an ASKER-C hardness of from about 45° to 70°, and which contacts the intermediate transfer body, with a printing medium being interposed therebetween, and transfers the toner image from the intermediate transfer body to the printing medium. The transfer unit may further include: a de-electrifying member having a DC power and an AC power concurrently applied thereto, to de-electrify the printing.

10 Claims, 5 Drawing Sheets

U.S. PATENT DOCUMENTS

| | | | | |
|---|---|---|---|---|
| 7,160,663 | B2 | 1/2007 | Komoto et al. | |
| 7,336,918 | B2 | 2/2008 | Tsujita | |
| 2005/0058473 | A1 * | 3/2005 | Mizuno et al. | 399/302 |
| 2006/0183615 | A1 | 8/2006 | Eun et al. | |
| 2006/0228125 | A1 | 10/2006 | Itagaki et al. | |
| 2007/0258737 | A1 * | 11/2007 | Ogiyama et al. | 399/315 |
| 2007/0297819 | A1 | 12/2007 | Hagiwara et al. | |
| 2008/0181654 | A1 | 7/2008 | Sakagawa et al. | |
| 2008/0285993 | A1 | 11/2008 | Ishida | |

FOREIGN PATENT DOCUMENTS

| | | |
|---|---|---|
| JP | 2002-365923 | 12/2002 |

OTHER PUBLICATIONS

Supplemental Notice of Allowability dated Sep. 21, 2010 for related U.S. Appl. No. 12/025,175.

Notice of Allowability dated Jul. 26, 2010 for related U.S. Appl. No. 12/025,175.

Office Action dated Feb. 8, 2010 for related U.S. Appl. No. 12/025,175.

Office Action dated Jun. 24, 2009 for related U.S. Appl. No. 12/025,175.

* cited by examiner

TRANSFER UNIT AND IMAGE FORMING APPARATUS EMPLOYING THE SAME

CROSS-REFERENCE TO RELATED APPLICATION

This application is a continuation application of U.S. Ser. No. 12/025,175, filed on Feb. 4, 2008 now U.S. Pat. No. 7,848,691 which is now allowed, the disclosure of which is incorporated herein by reference. This application claims the benefit of Korean Application No. 2007-60246, filed Jun. 20, 2007, in the Korean Intellectual Property Office, the disclosure of which is incorporated herein by reference.

BACKGROUND OF THE INVENTION

1. Field of the Invention

Aspects of the present invention relate to a transfer unit and an image forming apparatus employing the same.

2. Description of the Related Art

In general, a color image forming apparatus forms toner images of various colors on a plurality of image supports and superimposes the toner images on a printing medium using a transfer unit. A transfer unit typically includes an intermediate transfer body. The toner images are transferred from the plurality of image supports onto the intermediate transfer body, such that the toner images are overlapped to form a color image. A transfer member transfers the color image from the intermediate transfer body to the printing medium.

A high voltage is applied to the intermediate transfer body and the transfer member, and thus, the printing medium passing there through is electrified at a certain electric potential. The electrified printing medium may be attracted to the intermediate transfer body, after passing through the intermediate transfer body and the transfer member. Thus, there is a need to de-electrify the printing medium, to prevent the printing medium from being attracted to the intermediate transfer body.

To this end, a method for de-electrifying a printing medium, by applying a corona discharge to an electrified printing medium, has been developed. However, generating the corona discharge creates ozone, thereby causing an environmental problem. Such an image forming apparatus requires additional devices, such as, an ozone filter, a duct, and a fan, etc., to remove the ozone, thereby increasing manufacturing cost and lowering manufacturing efficiency.

As another method for de-electrifying a printing medium, an image forming apparatus including a grounded de-electrifying member, which is disposed adjacent to a printing medium, has been provided. This method is relatively effective, if an intermediate transfer body of the apparatus has a diameter of 40 mm or less. However, if the intermediate transfer body has a diameter larger than 40 mm, the de-electrification of the printing medium is insufficient, and thus, the printing medium may be attracted to the intermediate transfer body.

SUMMARY OF THE INVENTION

Aspect of the present invention provide a transfer unit, in which a printing medium can be easily separated from an intermediate transfer body, when the printing medium passes through the intermediate transfer body and a transfer member, and an image forming apparatus employing the same.

Aspects of the present invention provide a transfer unit, which can prevent ozone generation, while a printing medium is being separated from an intermediate transfer body, and an image forming apparatus employing the same.

The foregoing and/or other aspects of the present invention can be achieved by providing a transfer unit, which transfers a toner image formed on an image support. The transfer unit comprises: an intermediate transfer body that has a curved transfer surface having an ASKER-A hardness of 25° to 40°, on which the toner image on the image support is transferred; a transfer member, which has an ASKER-C hardness of 45° to 70° and which contacts the intermediate transfer body with a printing medium being interposed therebetween, and which transfers the toner image from the intermediate transfer body to the printing medium.

The transfer unit may further comprise a de-electrifying member, to which a DC power and an AC power are applied, to de-electrify the printing medium.

The DC power may have a voltage of from about 200V to 800V and the AC power may have a voltage of from about |3.0| kV to |3.6| kV. For example, the AC power can have a voltage of from about |3.4| kV to |3.6| kV.

According to aspects of the present invention, the AC power may have a frequency of from about 700 Hz to 850 Hz.

According to aspects of the present invention, the de-electrifying member may comprise a plurality of teeth, which extend across a traveling direction of the printing medium, and face the printing medium. A distance between the teeth and a contact nip, formed between the intermediate transfer body and the transfer member, may be less than about 12 mm.

According to aspects of the present invention, an average current of the DC power and the AC power, applied to the de-electrifying member, may be approximately 0.

The foregoing and/or other aspects of the present invention can be also achieved by providing an image forming apparatus comprising: an image support, on which an electrostatic latent image is formed; a developing unit, which supplies developer to the image support, to form a toner image; the transfer unit as described above, which transfers the toner image on the image support to a printing medium; and a fixing unit, which fuses the toner image on the printing medium.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EXEMPLARY EMBODIMENTS

Figure 1:
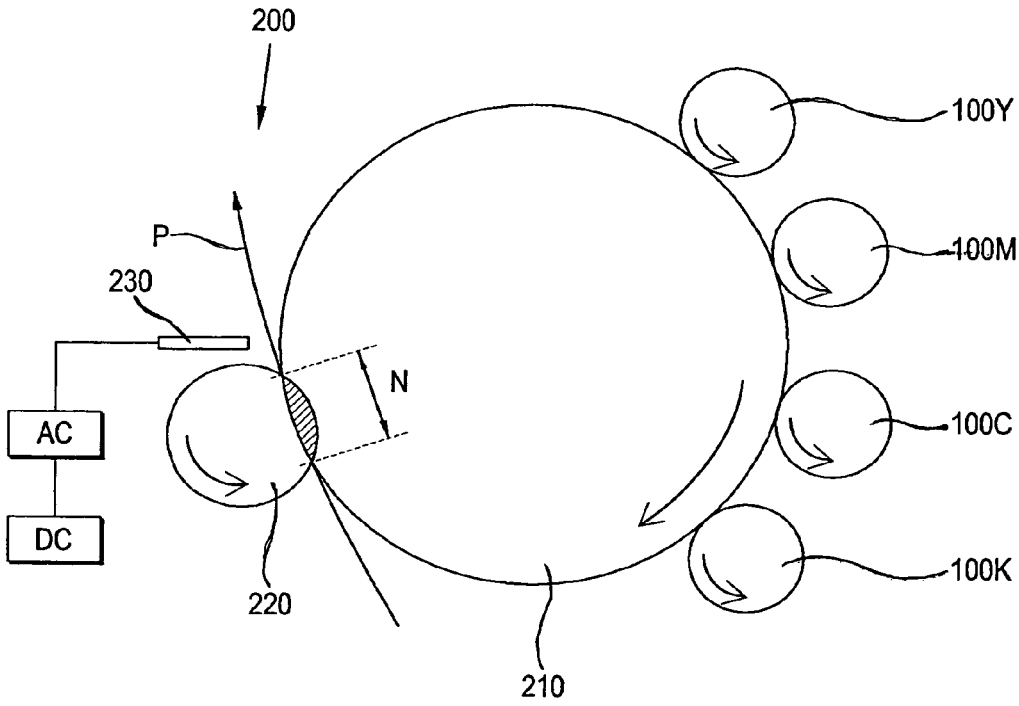
FIG. 1 is a schematic section view illustrating a transfer unit, according to an exemplary embodiment of the present invention.

Reference will now be made in detail to the exemplary embodiments of the present invention, examples of which are illustrated in the accompanying drawings, wherein like reference numerals refer to like elements throughout. The exemplary embodiments are described below so as to explain the present invention, by referring to the figures.

Figure 2:
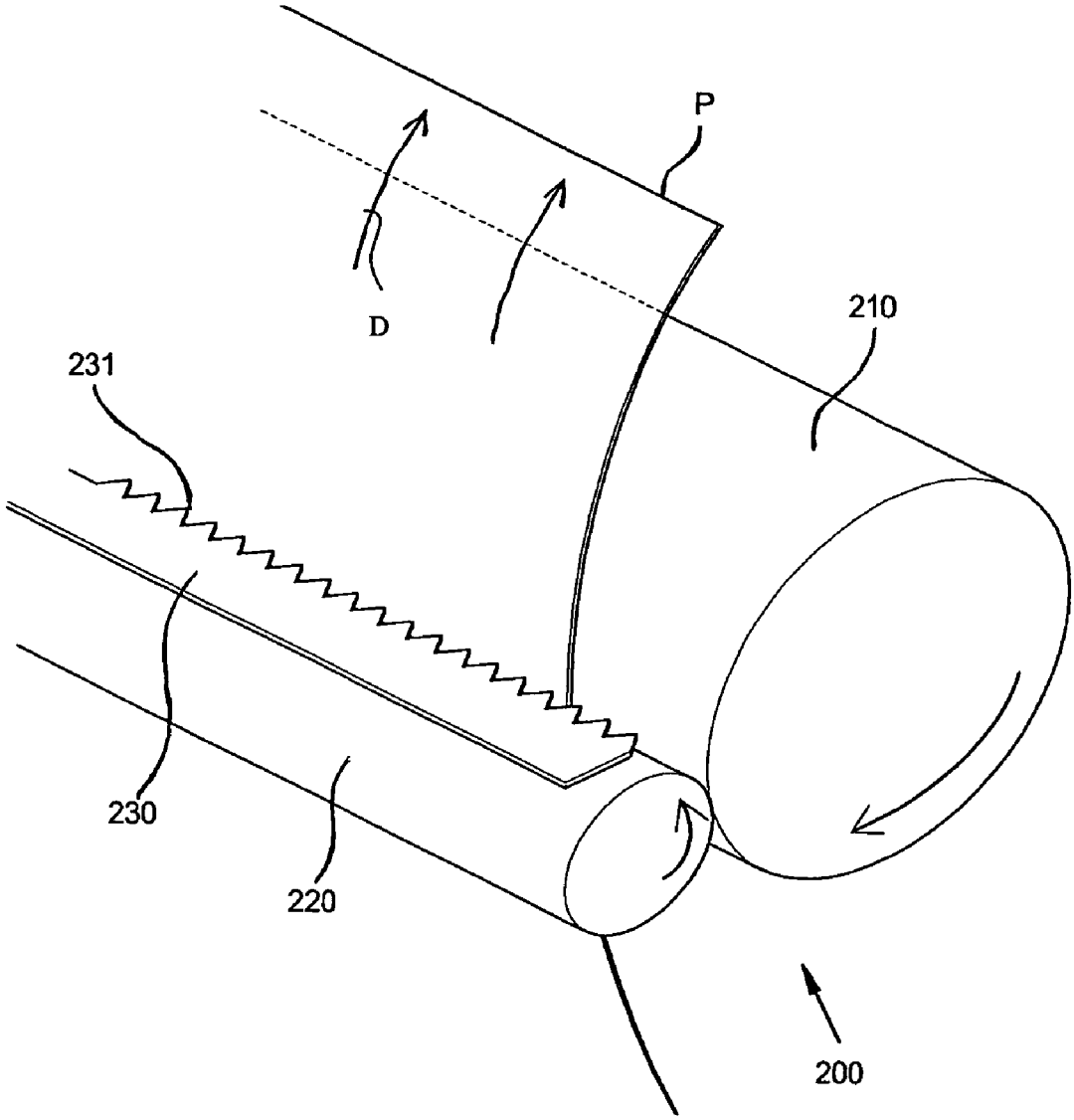
FIG. 2 is a perspective view illustrating a main part of the transfer unit of FIG. 1.

Referring to FIGS. 1 and 2, a transfer unit 200, according to an exemplary embodiment of the present invention, includes: an intermediate transfer body 210, on which toner images are transferred from image supports 100Y, 100M, 100C, and 100K, to form color images; a transfer member 220, which transfers the color images from the intermediate transfer body 210 to a printing medium P. The transfer unit 200 may further include a de-electrifying member 230, which de-electrifies the printing medium P. The color images are formed by overlapping the toner images on the intermediate transfer body 210. The image supports 100Y, 100M, 100C, and 100K can each be a photo sensitive drum or any device capable of forming a toner image.

Each of the image supports 100Y, 100M, 100C, and 100K has a cylindrical shape and a length corresponding to the width of the printing medium P. Each of the image supports 100Y, 100M, 100C, and 100K corresponds to a different developer, for example, a yellow, a magenta, a cyan, and a black developer. The image supports 100Y, 100M, 100C, and 100K are sequentially arranged around and in contact with the intermediate transfer body 210. The present teachings are not limited to any particular number of image supports.

Electrostatic latent images, corresponding to each toner image, are formed on the image supports 100Y, 100M, 100C, and 100K, using a predetermined electric potential difference. The toner images are formed by applying a respective developer to each of the electrostatic latent images. The plurality of image supports 100Y, 100M, 100C, and 100K each form a toner image having a different color, which are then transferred to the printing medium P. The toner images are overlapped with one another, to thereby form a color image.

The transfer of the toner images, from the image supports 100Y, 100M, 100C, and 100K to the printing medium, is performed in conjunction with the transfer unit 200. The transfer unit 200 is arranged in opposition to the plurality of the image supports 100Y, 100M, 100C, and 100K.

The intermediate transfer body 210 is cylindrically shaped. The plurality of image supports 100Y, 100M, 100C, and 100K; and the transfer member 220 are disposed around the circumference of the intermediate transfer body 210. The image supports 100Y, 100M, 100C, and 100K; and the transfer member 220 are positioned on opposite sides of the intermediate transfer body 210. The intermediate transfer body 210 has a diameter such that the plurality of image supports 100Y, 100M, 100C, and 100K can be spaced apart from one another. For example, the intermediate transfer body 210 may have a diameter of from about 120 mm to 130 mm. The intermediate transfer body 210 may have an electrical resistance of from about $10^6\Omega$ to $10^9\Omega$, to facilitate image transference.

The intermediate transfer body 210 rotates in contact with the image supports 100Y, 100M, 100C, and 100K. To form the color image, the toner image on the first image support 100Y is transferred to the intermediate transfer body 210, and then, the toner images on the image supports 100M, 100C, and 100K are sequentially transferred to the intermediate transfer body 210. The sequential transfer is performed such that the toner images overlap one another and form the color image on the intermediate transfer body 210. This process can be referred to as an intermediate transfer.

The transfer member 220 is cylindrically shaped, and rotates in contact with the intermediate transfer body 210, with the printing medium P being interposed therebetween. The transfer member 220 presses the printing medium P against the transfer member 220, to transfer the color image onto the printing medium P.

The transfer member 220 contacts the transfer body 210 at a contact nip N. The toner image is transferred to the printing medium P from the intermediate body 210 at the contact nip N, as the printing medium passes through the contact nip N. This process can be referred to as a final transfer. The transfer member 220 has a relatively smaller diameter of, for example, about 18.5 mm, as compared with the diameter intermediate transfer body 210.

For the intermediate transfer and the final transfer, high voltages are applied to the intermediate transfer body 210 and/or the transfer member 220. Accordingly, the printing medium P is electrified at a certain electric potential, while passing through the intermediate transfer body 210 and the transfer member 220. The electrification of the printing medium P may cause the printing medium P to become attracted to the intermediate transfer body 210 and can disrupt the movement of the printing medium P. The attraction may be static attraction. The static attraction may cause the printing medium to wrap around the intermediate transfer body 210. The de-electrifying member 230 can de-electrify (remove the static charge from) the printing medium P.

As shown in FIG. 2, the de-electrifying member 230 is disposed across a traveling direction D of the printing medium P. The de-electrifying member 230 has a plurality of teeth 231 disposed on an edge thereof. The de-electrifying member 230 is arranged in parallel with the transfer member 220, adjacent to an exit of the contact nip N, where the printing medium P exits the contact nip N.

The teeth can be disposed in a row that extends parallel to the exit. The teeth extend generally orthogonally to the traveling direction D, for example, the teeth can point toward the printing medium P, as the printing medium P exits the contact nip N. A distance between the teeth 231 and the contact nip N can be about 12 mm or less. If the distance between the teeth 231 and the contact nip N is greater than about 12 mm, the effectiveness of the de-electrification to the printing medium P may be reduced.

A direct current (DC) power and an alternating current (AC) power are concurrently applied to the de-electrifying member 230, to thereby generate an electric discharge on the teeth 231. The printing medium P is de-electrified by the electric discharge. Here, the DC power and the AC power may stabilize one another and increase the de-electrifying efficiency.

The DC power may have a voltage of from about 200V to 800V, and the AC power may have a voltage of from about |3.0| kV to |3.6| kV and have a frequency of from about 700 Hz to 850 Hz. If the voltages are lower than the above values, the de-electrification to the printing medium P may be insufficient.

If the voltages are higher than the above values, an image to be transferred may be shifted from its proper position on the printing medium P, and the quality of the image may deteriorate, due to excessive de-electrification. Furthermore, the energy costs associated therewith may be increased. If the AC power is greater than |4.0| kV, ozone of several parts per million (ppm) may be generated, to thereby cause an environmental problem.

If the printing medium P moves in a nearly vertical direction, between the intermediate transfer body 210 and the transfer member 220, the weight of the printing medium P may be insufficient to separate the printing medium P from the intermediate transfer body 210. In this case, if the hardness of the intermediate transfer body 210 is greater than that of the transfer member 220, the printing medium P may be bent toward the intermediate transfer body 210, while passing through the contact nip N. Thus, the printing medium P may curl around to the intermediate transfer body 210, in spite of the de-electrification.

The hardness of the intermediate transfer body 210 can be less than that of the transfer member 220, so that the printing medium P is bent toward the transfer member 220. In such a configuration, the contact nip N has a concave surface that bends toward the transfer member 220, to make the printing medium P to bend toward the transfer member 220.

The intermediate transfer, body 210 may have an ASKER-A hardness, and the transfer member 220 may have an ASKER-C hardness. More particularly, the intermediate transfer body 210 may have an ASKER-A hardness of 40° or less, and the transfer member 220 may have an ASKER-C hardness of 45° or more. The printing medium P may be easily separated from the intermediate transfer body 210, under the above hardness conditions.

The ASKER-A hardness of the intermediate transfer body 210 can be about 25° or more. If the hardness of the intermediate transfer body 210 is below about 25°, it may be difficult to manufacture the intermediate transfer body 210. Further, the physical characteristics of the intermediate transfer body 210 and the image supports 100Y, 100M, 100C, and 100K can significantly vary, and thus, an effective intermediate transfer becomes difficult.

The ASKER-C hardness of the transfer member 220 may be about 70° or less. If the hardness of the transfer member 220 is above about 70°, the physical characteristics of the transfer member 220 and the transfer body 210 may vary significantly, and thus, the transfer of the toner image to the transfer member 220 can become difficult.

An experimental example for separation of the printing medium P will be hereinafter described. The experimental conditions are as follows:

Kind of printing medium: 75 g/m$^2$;
Temperature and humidity: normal;
Image transfer pattern: cross batch or solid;
Material of de-electrifying member: stainless steel;
Distance between teeth and contact nip: 9-10 mm;
Hardness of intermediate transfer body: ASKER-A 35°; and
Hardness of transfer member: ASKER-C 47°.

Under the experimental conditions, various DC powers and various AC powers were concurrently applied to the de-electrifying member 230. The degree of separation of the printing medium P from the intermediate transfer body 210, according to the applied DC powers and AC powers, is as shown in the following table:

| | AC\|3.0\|kV | AC\|3.2\|kV | AC\|3.4\|kV | AC\|3.6\|kV |
|---|---|---|---|---|
| DC + 0 V | ○○ | ○○○ | ○○ | ○○ |
| DC + 200 V | ○○ | ○○ | ○○○ | ○○○ |
| DC + 400 V | ○ | ○○ | ○○○ | ○○○ |
| DC + 600 V | X | ○○ | ○○○ | ○○○ |
| DC + 800 V | X | ○ | ○○○ | ○○○ |
| DC + 1000 V | X | ○ | X | ○○○ |

For experiment, ten sample printing media P were passed through the contact nip N.
The experimental results in the above table have the following meanings:
○○○: 10 printing media separated;
○○: 8 or 9 printing media separated;
○: 4 or 5 printing media separated; and
X: no printing medium separated.

As shown in the table, it was found that the experimental results might be practically acceptable when the DC power was in the range of 200V to 800V and the AC power was in the range of |3.0| kV to |3.6| kV. In particular, the most effective results were obtained when the DC power was in the range of 200-800V and the AC power was in the range of |3.4|-|3.6| kV. In this case, all sample printing media were separated from the intermediate transfer body 210.

Using the DC and AC powers determined above to be the most effective, the hardness of the intermediate transfer body 210 and the hardness of the transfer member 220 were varied. It was found that when the hardness of the intermediate transfer body 210 was above ASKER-A 40°, or when the hardness of the transfer member 220 was below ASKER-C 45°, the printing medium P did not separate from the intermediate transfer body 210.

Figure 3:
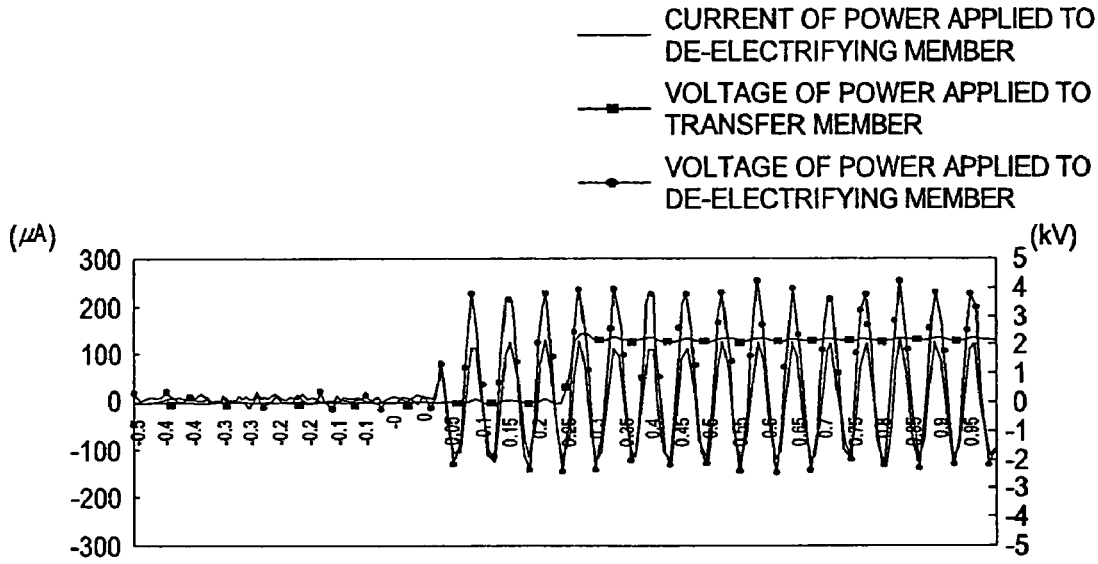
FIG. 3 is a graph showing changes in voltage and current over time, when a DC power of +800V and an AC power of |3.4| kv are simultaneously applied to a de-electrifying member of the transfer unit in FIG. 1.
Figure 4:
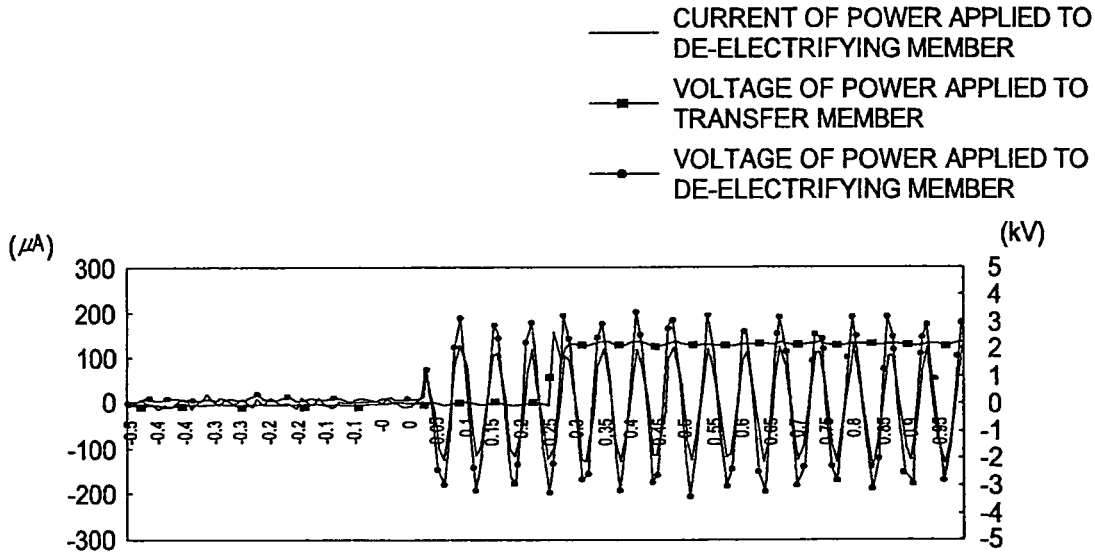
FIG. 4 is a graph showing changes in voltage and current over time, when an AC power of |3.4| kv is applied to the de-electrifying member in the transfer unit in FIG. 1.

FIG. 3 is a graph showing changes in voltage and current over time, when a DC power of +800V and an AC power of |3.4| kV were concurrently applied to the de-electrifying member 230. FIG. 4 is a graph showing changes in voltage and current according over time, when an AC power of |3.4| kV was applied to the de-electrifying member 230. The abscissa represents time, and the ordinates represent voltage and current, respectively.

Each of FIGS. 3 and 4 includes two sine waves having different amplitudes, with the high amplitude wave representing a change in voltage and the low amplitude wave representing a change in current. The lines including a sign "■" first maintain 0 kV and sharply rise to about 2 kV, represent a change in a DC power applied to the transfer member 220, to transfer the toner image from the intermediate transfer body 210 to the printing medium P.

As shown in FIG. 3, when the DC power of +800V and the AC power of |3.4| kV are concurrently applied, the maximum voltage is +4.2 kV, the minimum voltage is −2.6 kV, and the average voltage is +0.839 kV; and the maximum current is 144 μA, the minimum current is −128 μA, the average current is +0.59 μA.

As shown in FIG. 4, when only the AC power of |3.4| kV is applied, the maximum voltage is +3.6 kV, the minimum voltage is −3.4 kV, and the average voltage is +0.019 kV; and the maximum current is +128 μA, the minimum current is −144 μA, the average current is −2.73 μA.

An average current of the concurrently applied DC and AC powers is approximately 0. The de-electrification becomes more effective as the average current approaches 0. If the average current is more negative, the de-electrification may be insufficient, and thus, the separation of the printing medium P may become difficult. On the other hand, if the average current is more positive, the de-electrification may become insignificant, and the printing medium P may be inversely electrified.

As shown in FIGS. 3 and 4, the average current is near 0, in the case that the DC power of +800V and the AC power of |3.4| kV are concurrently applied, as compared with the case that only the AC power of |3.4| kV is applied. In the former case, the de-electrification and the separation of the printing medium P is relatively effective. As described above, according to an exemplary embodiment of the present invention, the DC power having the voltage of 200V to 800V and the AC power having the voltage of |3.0| kV to |3.6| kV and the frequency of 700 Hz to 850 Hz may be concurrently applied to the de-electrifying member 230.

Figure 5:
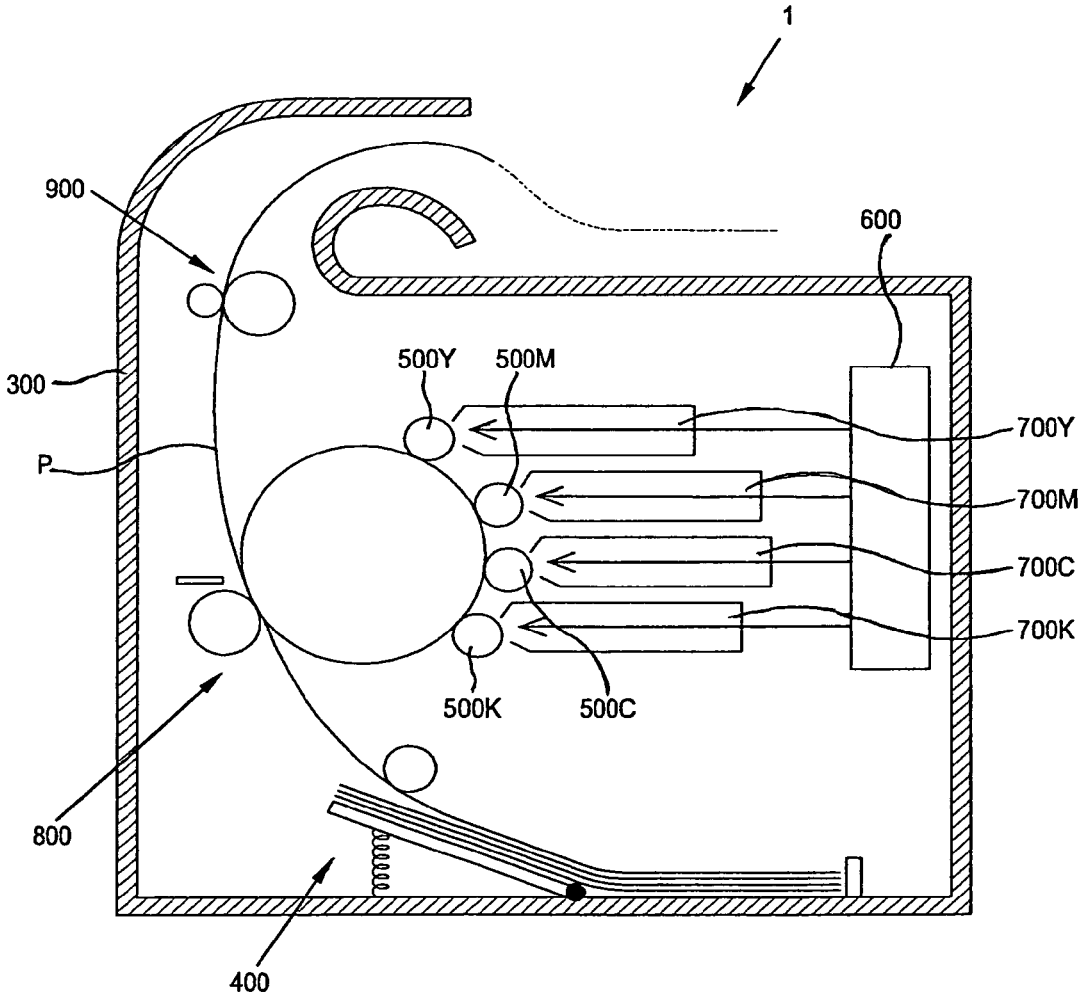
FIG. 5 schematically illustrates an image forming apparatus employing the transfer unit in FIG. 1.

FIG. 5 illustrates a tandem-type, color image forming apparatus 1, according to an exemplary embodiment of the present invention. The image forming apparatus 1 includes: a main casing 300; a printing medium supply unit 400, which supplies a printing medium P; a plurality of image supports 500Y, 500M, 500C, and 500K; a light scan unit 600, which scans a beam to the image supports 500Y, 500M, 500C, and 500K, to form electrostatic latent images; developing units 700Y, 700M, 700C, and 700K, which supply developers to the image supports 500Y, 500M, 500C, and 500K, to form toner images, a transfer unit 800, which transfers the toner images from the image supports 500Y, 500M, 500C, and 500K to the printing medium P as a color image; and a fixing unit, which fuses the color image to the printing medium P.

The colors of the toner images on the image supports 500Y, 500M, 500C, and 500K correspond to colors of developers in the developing units 500Y, 500M, 500C, and 500K, respectively. Configurations and operations of the image supports 500Y, 500M, 500C, and 500K and the transfer unit 800 are substantially the same as those of the image supports 100Y, 100M, 100C, and 100K and the transfer unit 200, as described above, and thus, a detailed description thereof will be omitted.

As described above, according to aspects of the present invention, a printing medium on which an image is formed can be prevented from being adhered to an intermediate transfer body. Ozone generation can be minimized when the printing medium is separated from the intermediate transfer body, and accordingly, a device for eliminating ozone is not required.

Although a few exemplary embodiments of the present invention have been shown and described, it would be appreciated by those skilled in the art that changes may be made in these exemplary embodiments, without departing from the principles and spirit of the invention, the scope of which is defined in the claims and their equivalents.

What is claimed is:

1. An image forming apparatus comprising:

a printing medium supply unit which supplies a printing medium;

a plurality of image carrying bodies;

a light scan unit which scans a beam to the image carrying bodies to form electrostatic latent images;

a plurality of developing units which supply developers to the image carrying bodies to form visible images;

a transfer unit which transfers the visible images from the image carrying bodies to the printing medium as a color image; and a fixing unit which fuses the color image to the printing medium, the transfer unit comprising:

an intermediate transfer body to receive the images from the image carrying bodies, having a curved transfer surface, and having an ASKER-A hardness of about 25° to 40°;

a transfer member having an ASKER-C hardness of about 45° to 70°, disposed in contact with the intermediate transfer body at a nip, and transferring the images from the intermediate transfer body to the printing medium at the nip; and a de-electrifying member to de-electrify the printing medium, disposed adjacent to an exit of the nip, and having a DC power and an AC power concurrently applied thereto, wherein the DC power has a voltage of about 200V to 800V and the AC power has a voltage of about |3.0| kV to |3.6| kV.

2. The image forming apparatus according to claim 1, wherein the print medium substantially vertically passes through the nip.

3. The image forming apparatus according to claim 1, wherein the AC power has a frequency of about 700 Hz to 850 Hz.

4. The image forming apparatus according to claim 1, wherein the de-electrifying member comprises teeth disposed in a row extending across and substantially perpendicular to the exit of the nip, wherein a distance between the teeth and the nip is about 12 mm or less.

5. The image forming apparatus according to claim 1, wherein an average current of the DC power and the AC power is approximately 0.

6. The image forming apparatus according to claim 1, wherein the plurality of image carrying bodies are provided corresponding to yellow, magenta, cyan and black (YMCK) colors, respectively, and the image carrying bodies corresponding to the respective colors are sequentially arranged in a rotating direction of the intermediate transfer body.

7. The image forming apparatus according to claim 6, wherein the intermediate transfer body has a diameter of about 120 mm to 130 mm.

8. The image forming apparatus according to claim 7, wherein a diameter of the transfer member is smaller than the diameter of the intermediate transfer body by at least 100 mm or more.

9. The image forming apparatus according to claim 6, wherein when a rotational center of the intermediate transfer body is regarded as an origin on a plane parallel with a radial direction of the intermediate transfer body, a first contact point, a second contact point, a third contact point and a fourth contact point between the intermediate transfer body and the respective image carrying bodies sequentially arranged in the rotating direction of the intermediate transfer body, and a fifth contact point between the intermediate transfer body and the transfer member satisfy $c>a>0$, $b>d>0$, $e>g>0$, $0>f>h$, $0>i$ and $0>j$, and where, a, c, e, g and i respectively indicate abscissas of the first contact point, the second contact point, the third contact point, the fourth contact point and the fifth contact point, and b, d, f, h and j respectively indicate ordinates of the first contact point, the second contact point, the third contact point, the fourth contact point and the fifth contact point.

10. The image forming apparatus according to claim 9, wherein the image carrying body for yellow corresponds to the first contact point, the image carrying body for magenta corresponds to the second contact point, the image carrying body for cyan corresponds to the third contact point, and the image carrying body for black corresponds to the fourth contact point.

* * * * *